US006385874B1

(12) United States Patent
Tsonas

(10) Patent No.: US 6,385,874 B1
(45) Date of Patent: May 14, 2002

(54) DECORATIVE CARD FOR USE WITH PRODUCT

(76) Inventor: Jeanette Tsonas, 79 Jacksonville Dr., Parsippany, NJ (US) 07054

( * ) Notice: Subject to any disclaimer, the term of this patent is extended or adjusted under 35 U.S.C. 154(b) by 0 days.

(21) Appl. No.: 09/641,726

(22) Filed: Aug. 21, 2000

(51) Int. Cl.[7] ..... G09F 3/04
(52) U.S. Cl. ..... 40/124.09; 40/310
(58) Field of Search ..... 40/310, 124.09

(56) References Cited

U.S. PATENT DOCUMENTS

| | | | | | |
|---|---|---|---|---|---|
| 1,144,086 | A | * | 6/1915 | Achenbach | 40/310 |
| 1,536,445 | A | * | 5/1925 | Maupai | 40/310 |
| 2,138,361 | A | * | 11/1938 | Snelling | 40/310 |
| 2,340,719 | A | * | 2/1944 | Walter | 40/310 |
| 3,831,300 | A | * | 8/1974 | Berkhouse | 40/310 |
| 3,996,679 | A | * | 12/1976 | Warneke | 40/1.5 |

* cited by examiner

*Primary Examiner*—Cassandra H. Davis

(74) *Attorney, Agent, or Firm*—Miles & Stockbridge P.C.; John C. Kerins

(57) ABSTRACT

Spaced upper and lower sections are connected to medial sections by fold lines forming a pleat. The upper, lower and medial sections have decorative indicia forming an integrated decorative image. One or more of the indicia bearing sections have tongues that span the pleat and, optionally, mate in slits or openings to form these sections into an integrated, front indicia bearing portion of the card. The medial sections of the pleat between the upper and lower sections are folded back from the upper and lower sections into a substantially juxtaposed relation. The tongue or tongues comprise material from at least one of the medial sections which is broken free of the medial section to form an opening therein. Both medial sections have openings, which openings align when the sections are juxtaposed for receiving a product. When positioned on the product, the upper and lower sections bearing the decorative indicia extend along one face of the product, and, in cooperation with the tongue, can hide much of the product when viewed in a "front-on" orientation. The tongue or tongues may have indicia thereon which continue the integrated image of the other sections when the other indicia bearing sections are spaced from each other for a given product. Various embodiments are disclosed.

19 Claims, 6 Drawing Sheets

DECORATIVE CARD FOR USE WITH PRODUCT

BACKGROUND OF THE INVENTION

1. Field of the Invention

The present invention relates to decorative gift or product cards.

2. Description of Related Art

It is known to display a product message using a card with an opening that fits around the neck of a bottle or other product. These display cards typically convey a commercial message such as price on a simple two-dimensional panel without a three-dimensional aspect.

In U.S. Pat. No. 4,208,819, a booklet has a rear panel having an opening that fits over the neck of a bottle. As is typical with prior art, this article again offers a simple two-dimensional panel.

In U.S. Pat. No. 4,309,835 a premium can be hung from the neck of a bottle by a panel having a circular opening. The premium is a panel that can be folded into a frame. This arrangement is rather complex and is dedicated to fabricating the frame and is not easily adapted to displaying a greeting or decorative indicia.

In U.S. Pat. No. 5,348,156 a panel can be folded into a box having a braced extension with a hole that fits over the neck of a bottle. Again, this arrangement is complex and not easily adapted to displaying a greeting or a decorative indicia. Other US Patents of interest are U.S. Pat. Nos. 4,840,275 and 5,407,076.

The present inventor recognizes a need for a decorative greeting card or product card that is simple to use, attaches easily to the product, is pleasing to the eye, and can decorate various types of products, such as bottles, flower arrangements or other similar articles while covering a substantial portion of one face of the product. A need is seen for a decorative card that comprises a plurality of sections arranged to receive a product or gift, and including first and second sections which cooperate to form a single decorative card, and a further pleated portion for receiving the product or gift.

SUMMARY OF THE INVENTION

In accordance with the illustrative embodiments demonstrating features and advantages of the present invention, there is provided a decorative gift or product card including a sheet material first section, and a sheet material second section. Also included is a sheet material third section connected to the first section with a first fold line and having a first through opening. The card also includes a sheet material fourth section connected between the second and third sections with respective second and third fold lines. The fourth section has a second through opening. The card is initially produced in a substantially planar, sheet form. For use in deploying the card on a gift or other product, the third and fourth sections are folded in juxtaposed relation with the first and second openings juxtaposed such that the third and fourth sections project laterally outwardly from the respective first and second sections and the first and second sections are in approximately parallel planes.

As used herein, the term "juxtaposed", when used in describing the position of the third and fourth sections of the cards, is intended to define a position at which those sections are joined at a fold line, and the panels making up those sections extend in the same direction toward the first and second sections, but diverge at a relatively small (acute) angle. It is not intended that "juxtaposed" be limited to a construction in which the sections are mutually parallel. As used in describing the positions of the openings, "juxtaposed" is intended to mean in substantial alignment relative to an axis extending through the openings, wherein the openings are in relatively close proximity to one another.

In accordance with another aspect of the present invention, a decorative gift or product card again has a sheet material first section, and a sheet material second section. Also included is a sheet material third section connected to the first section with a first fold line and having a first through opening. This card also has a sheet material fourth section connected between the second and third sections with respective second and third fold lines. The fourth section has a second through opening. The third and fourth sections are folded in juxtaposed relation with the first and second openings juxtaposed such that the third and fourth sections extend from the respective first and second sections. The card has a tongue at the first opening. The first fold line is discontinuous with the tongue interposed between two lateral parts of the fold. The tongue is generally coplanar with the first section when the card is set up in its operational construction.

In accordance with still another aspect of the present invention, a decorative card that can be used with a product includes a sheet material formed into a plurality of first sections, which include means for forming the first sections into a single decorative panel. Each of the first sections forms a different portion of the panel. The card includes a product supporting sheet material member extending from at least one of the first sections and has an opening for receiving the product.

In one aspect, the sections are one piece and connected by fold lines. In a further aspect, the first sections comprise third and fourth sections, further including a tongue extending from the third section adjacent to the junction of the fourth section and the at least one second section.

In a further aspect, the further second section comprises fifth and sixth sections, each with an opening for receiving the product. In a further aspect, the first section includes a tongue forming the first opening, the first fold line being discontinuous adjacent to the tongue. Preferably, a tab extends from one of the first and second sections. The tab may be connected to the one first and second sections by a perforations for selective separation from the one first and second sections.

In a further aspect, at least one of the first and second openings is surrounded by a perforation for enlarging the one opening.

In a preferred embodiment, the card is made of a single blank that is folded with a central pleat. Indicia-bearing panels extend in opposite directions from the pleat and are approximately parallel or coplanar. The preferred pleat has openings that can fit around a product or gift. One of the openings in the preferred pleat can be formed by punching out a tongue that becomes part of one of the indicia-bearing panels, separate from the pleat.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
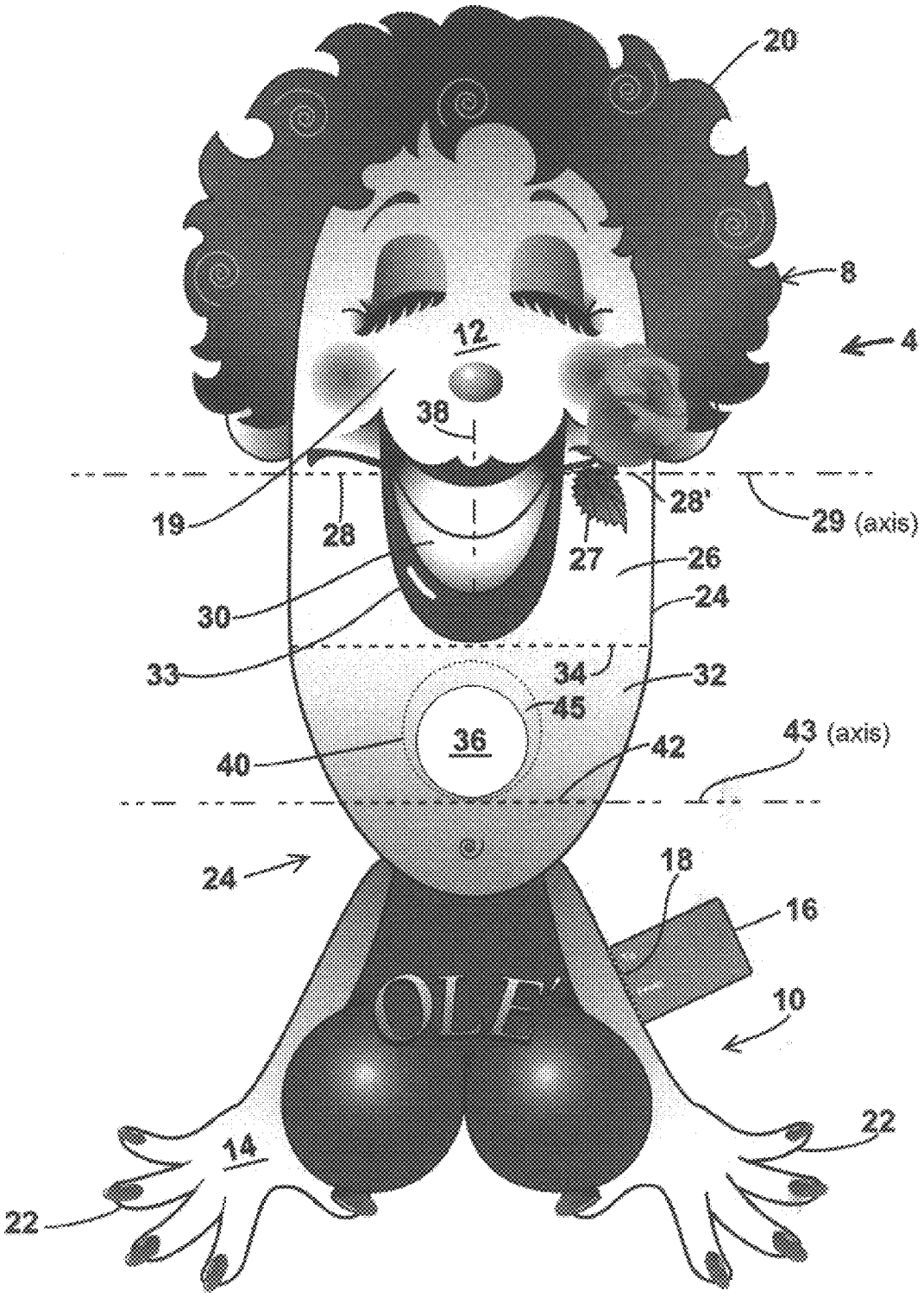
FIG. 1 is a front elevation view of a decorative product card blank according to the present invention.

Referring to FIG. 1, card 4 in the form of a blank 24 comprises an upper section 8 and a lower section 10, each with cooperating indicia 12 and 14, respectively. The sections 8 and 10 are also referred to herein as a first and second section, respectively. An addressable, informational tab 16 is attached to the lower section 10 with perforations 18. The sections 8 and 10 may be shaped as shown to conform to the indicia thereon such as a face 19, head of hair 20 and hands 22. The card 4 is preferably paperboard sheet material but may be thermoplastic sheet material or other sheet material as desired.

The card 4 comprises a blank 24 of stamped paperboard sheet material. The upper section 8 is connected to a first medial section 26 by fold lines 28, 28' which make up a discontinuous straight fold line aligned on axis 29. Section 8 has a shape consistent with the decorative indicia, whereas the section 26 may be rectangular or square or any other shape according to a given implementation. In this case, section 26 is rectangular. An elongated tongue 30 (referring to a card element, not any depiction of the indicia) extends from section 8 into the region of section 26 between the discontinuous fold lines 28, 28' on axis 29, which fold lines are adjacent to the tongue 30. The tongue 30 is U-shaped, formed by a U-shaped through-cut 33, which, in this embodiment, forms the outer periphery of the face indicia, i.e., the lower lip. The U-shaped cut 33 extends downwardly from the axis 29 and respective fold lines 28 and 28'.

An especially attractive appearance is achieved when the card is also provided with indicia on the folded panels with that indicia having continuity with the indicia on the frontal panels or sections. For example, in FIG. 1, sections 26 and 32, which are folded rearwardly when the card is assembled for use, show a continuation of the facial tones appearing on panels or sections 8 and the upper part of 10. When such indicia are provided on those folded panels, the image presented by the card appears much more contiguous, and adds a level of depth to the image.

Section 26 is connected to a further medial section 32 by fold line 34. Sections 26 and 32 are capable of forming a pleat and are also referred to herein as a third and fourth section, respectively. Section 32 has a circular through-opening 36 which may be shaped otherwise, e.g., square, rectangular, curved slot(s) etc. as desired. The opening 36 is aligned with the tongue 30 on axis 38 which preferably lies on the line of symmetry through the sections 8 and 10. This symmetry is not critical and the position of the opening 36 and tongue 30 may vary according to a particular implementation.

A ring of perforations 40 surrounds the circular opening 36. The perforations 40 permit the opening 36 to be enlarged to receive larger products than that received by opening 36, as will be explained. Section 32 is connected to section 10 by fold line 42 on axis 43. In an alternative embodiment, a slit (not shown) may be on the fold line 42 centrally thereof to receive a portion of the tongue 30 as may be desired in a given implementation. The slit may also be a slot as desired to accommodate thicker sheet material.

It should be understood that the fold lines described herein may be spaced perforations through the sheet material or may be creases in the sheet material as known in the paperboard forming art. Solid lines in the blank of FIG. 1 (excluding the indicia) represent through cuts and dashed lines represent fold lines. This notation will be used in other Figures. Also, the same reference numerals represent identical parts, and reference numerals with primes may represent similar parts.

Figure 2:
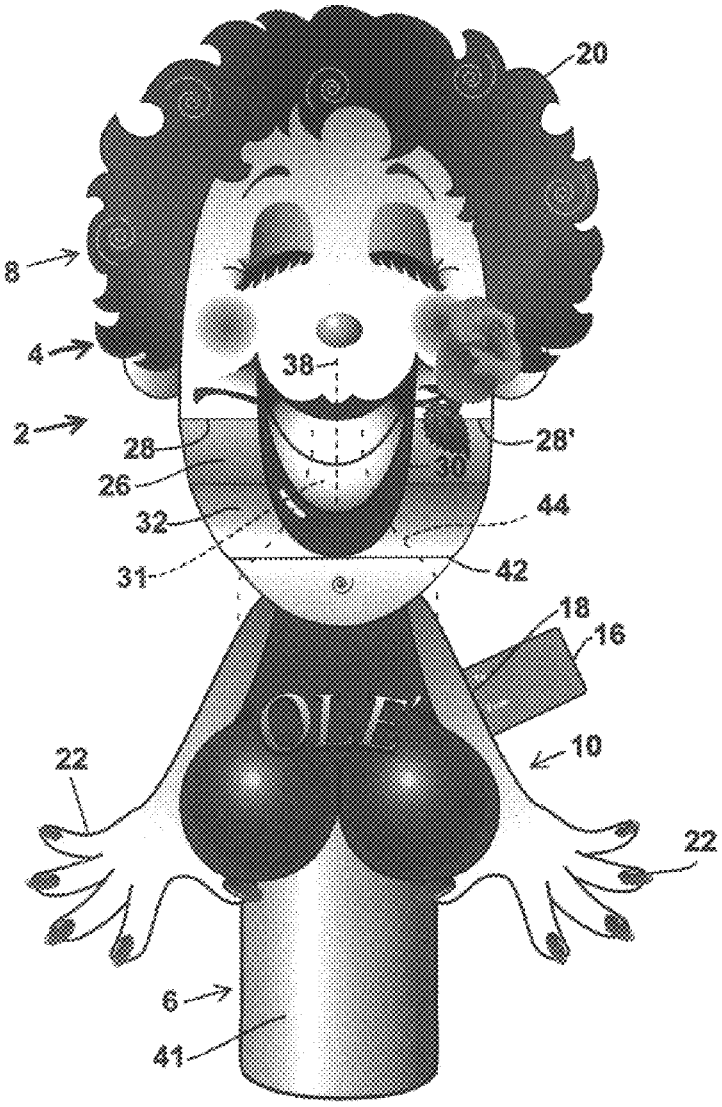
FIG. 2 is a front elevation view of the card of FIG. 1 folded and attached to a product.
Figure 3:
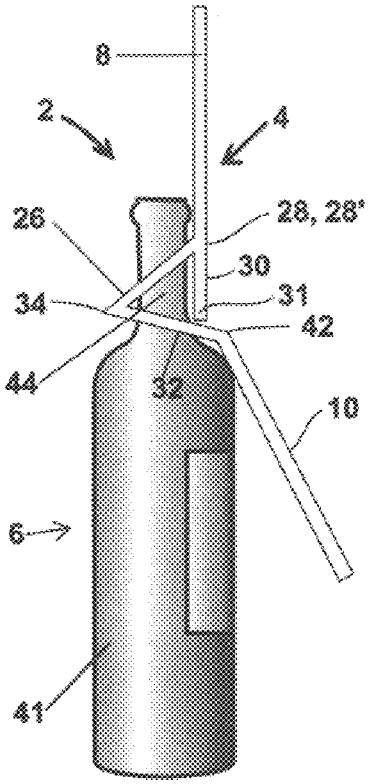
FIG. 3 is a side elevation view of the assembly of FIG. 2.

In FIGS. 2 and 3, assembly 2 comprises the card 4 of FIG. 1 folded for use with a bottle 6. The bottle 6 has a base 41 and a neck 44. Sections 26 and 32 are folded at respective fold lines 28, 28' at section 8 and at fold line 42 (FIG. 3) at section 10. These sections 26 and 32 are folded over so that they are juxtaposed in spaced inclined relation as in FIG. 3. In this embodiment, the sections 26 and 32 are inclined about 30° from each other but may be at any angle from parallel (abutting juxtaposed in parallel planes) to about 60°, for example. The sections 26 and 32 extend obliquely to the plane of the parallel and generally coplanar sections 8 and 10 and to axis 38 (FIG. 2).

The folding of section 26 relative to section 8 forms a U-shaped opening 31 in section 26 as the tongue 30 separates from the section 26 (along through-cut 33 of FIG. 1). The tongue 30 ceases being coplanar with section 26 as the section 26 is folded at fold lines 28, 28'.

The neck 44 of the bottle 6 passes through the opening 36 (FIG. 1) first and then through opening 31 left by the tongue. If the opening 36 is insufficiently large to accept the neck 44, the ring 45 (FIG. 1) formed by perforations 40 around the opening 36 may be removed.

In FIG. 1, while only one ring 45 and one annular ring of perforations 40 is shown, concentric rings of perforations may be provided to provide an opening of different sizes to receive various products of different sizes. As seen in FIG. 2, the decorative sections with decorative indicia on each section 8 and 10 cooperate to form a common, single, decorative, virtual image panel.

The tongue 30, FIGS. 2 and 3, extends between the spaced sections 8 and 10 and hides somewhat the bottle 6 behind the sections 8 and 10 and tongue 30. The dimensions of the tongue may differ for different embodiments and may have a width corresponding to the product associated with the card. Also, the tongue 30 has indicia thereon, shown in FIGS. 1 and 2 as a mouth, for example, that cooperates with the indicia on sections 8 and 10 to form a common cooperative image to form a decorative image panel.

Figure 4:
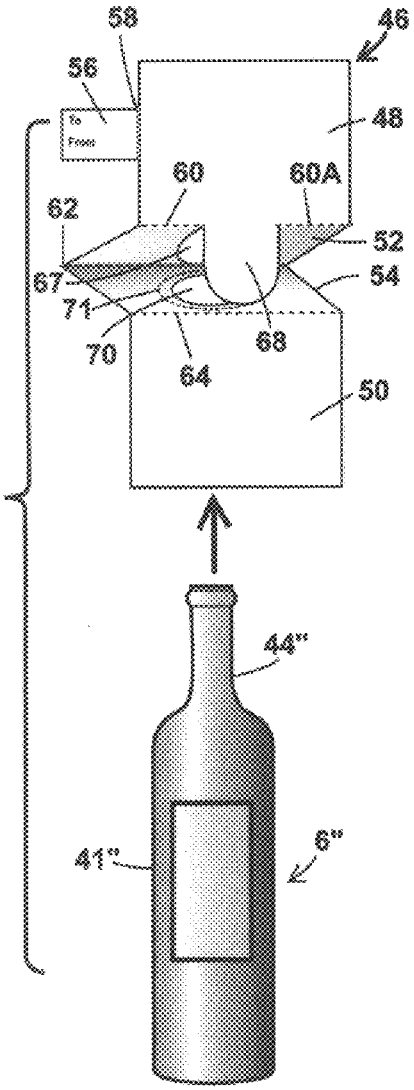
FIG. 4 is a front elevation, exploded, partially isometric view of a further embodiment of the card of the present invention about to be assembled to a product associated therewith.
Figure 5:
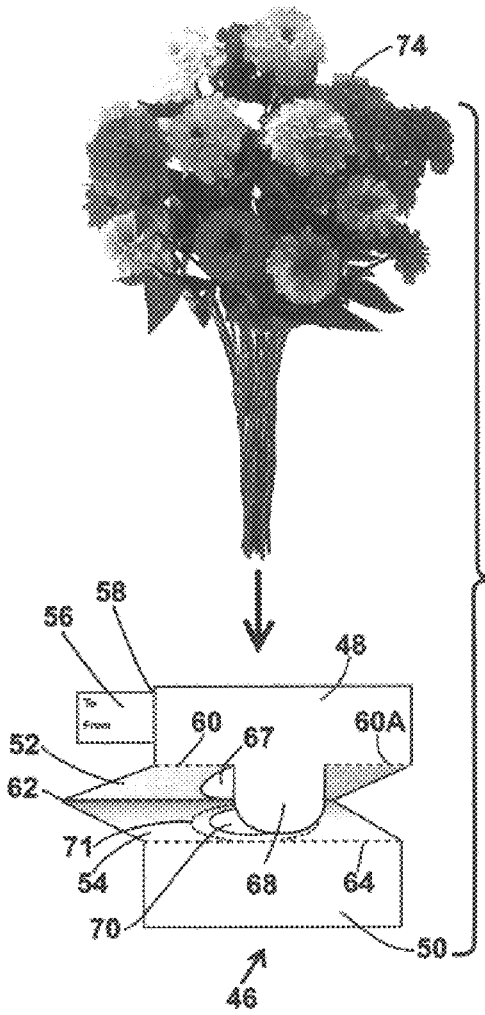
FIG. 5 is a view of a card having a construction similar to that of the card of FIG. 4 but with a different product.
Figure 6:
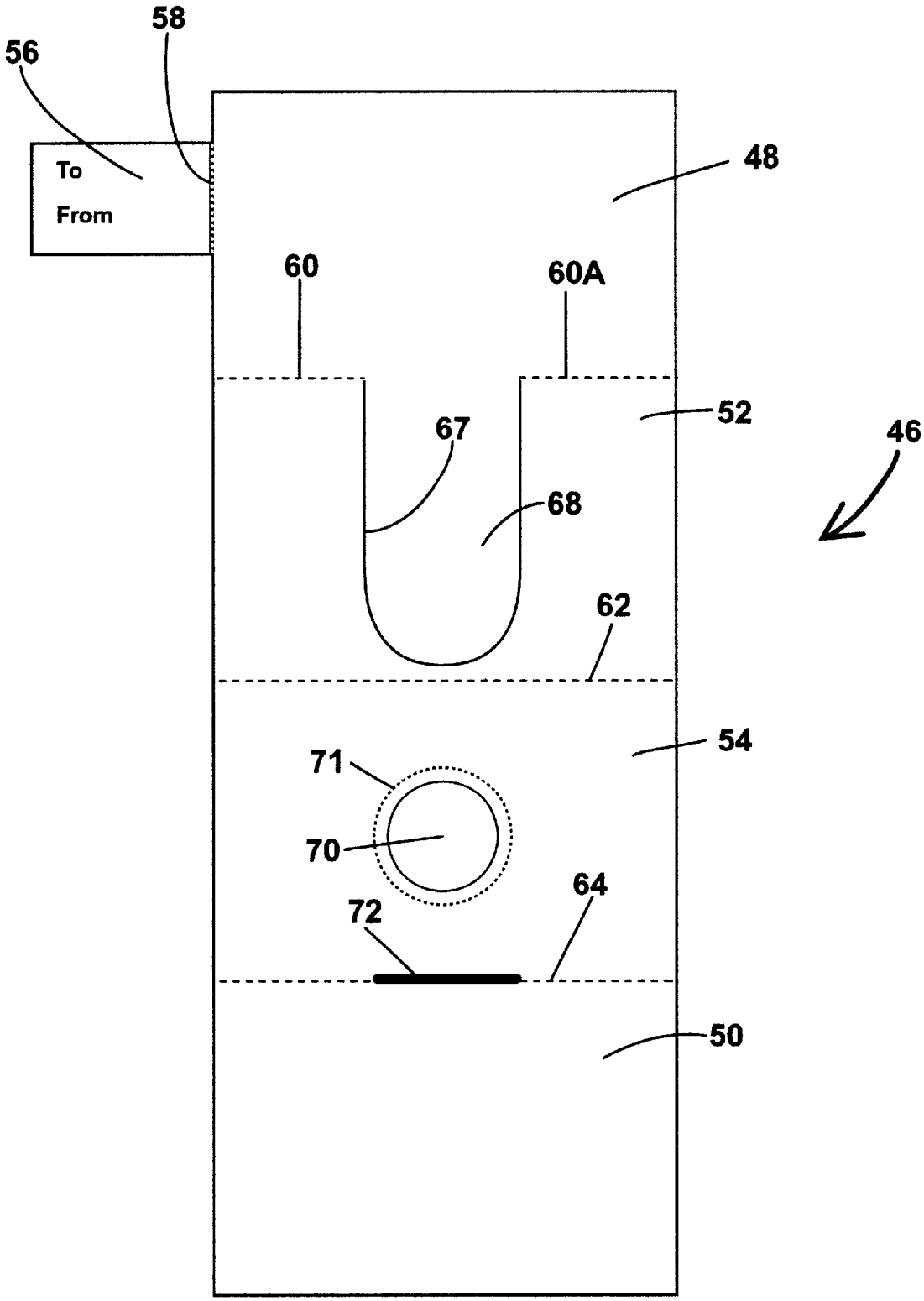
FIG. 6 is a front elevation view of the blank of the card of FIGS. 4 and 5.

FIGS. 4 and 5 show a different embodiment of a card 46 and FIG. 6 shows the card 46 in blank form. In FIGS. 4, 5 and 6, card 46 has sections 48 and 50 connected by medial sections 52 and 54 all connected by respective fold lines 60–60A, 62, and 64 as described above. Addressable tab 56 is connected to section 48 by perforations 58 so the tab may be selectively removed from section 48. The placement of the tab 56 is a matter of preference for the card designer, and may be placed on essentially any portion of the card. For presentation purposes, there is a general preference to have the tab 56 attached to either first section 48 or second section 50.

U-shaped opening 67 in section 52 is formed by the material vacated by tongue 68, which is separated from section 52 when the card is prepared for use, as shown in FIGS. 4 and 5. The tongue 68 is essentially coplanar with the section 48 while the sections 52 and 54 are folded over. While tongue 68 is shown as an element with two parallel sides terminating in a semi-circular end, this shape may be altered for styling or artistic reasons. For example, tongue 68 may be parabolic, polygonal, semi-ovoid, or some other arbitrary shape.

The opening 70 in section 54 aligns with the opening 67 to receive the neck 44" of bottle 6". The tongue 68 is adjacent to fold line 64. In the alternative, the end of the tongue may be inserted into a slit 72 at the fold line 64. In FIG. 5, card 46 may receive a bouquet 74 of flowers instead of a bottle. Perforation ring 71 (FIG. 6) surrounds the circular opening 70. It can be seen in comparing the cards of FIG. 4 and FIG. 5, that the frontal portions of the card, once folded for use, may take on either a generally vertical orientation, which is especially suitable for use with bottles, or a generally horizontal orientation, which is suitable for use with floral arrangement such that the flowers extend upwardly over the top edge of the card.

Figure 7:
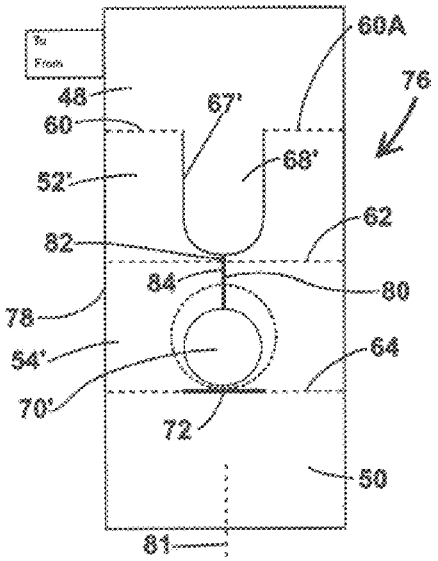
FIG. 7 is a front elevation view of a further embodiment of the blank comprising a variant of the FIG. 6 blank construction.
Figure 8:
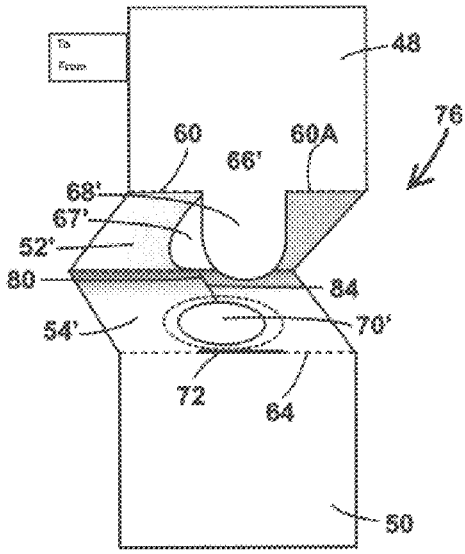
FIG. 8 is an isometric view of a partially folded card using the blank of FIG. 7.

In FIGS. 7 and 8, card 76 has a blank 78 substantially the same as the blank of card 46 of FIG. 6. The difference is that blank 78 has a slit 80 on axis 81 that connects the opening 67' (FIG. 8), left by tongue 68' after it is separated at throughout 66', and opening 70' in sections 52' and 54'. Slit 80 has portions 82 and 84 in respective sections 52' and 54', (FIG. 7). The slit portions 82 and 84 permit a larger product to fit in the openings 67' and 70' than otherwise would be permitted, since the sheet material, whether paperboard or plastic, is pliable and can be readily bent and folded over at the slit portions 82 and 84.

Figure 9:
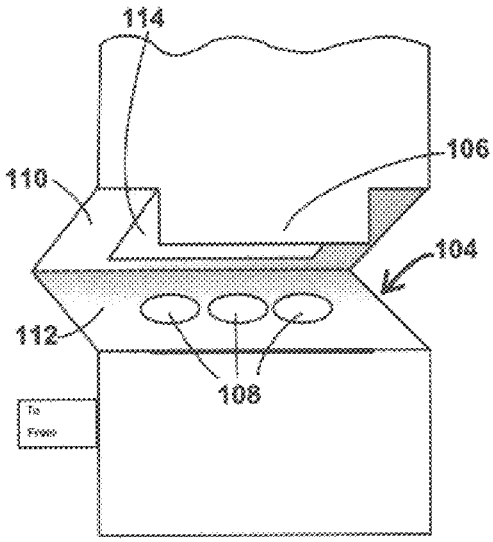
FIGS. 9, 10, 11 and 12 are isometric views similar to the view of FIG. 8, but directed to further embodiments of the card of the present invention.

In a further embodiment, in FIG. 9, card 104 has medial sections 110 and 112. Tongue 106 is an elongated rectangular member. Openings 108 in section 112 are aligned with tongue 106 so that three products (not shown) may be inserted into the card 104, the tongue 106 forming a single opening 114 that cooperates with all of the openings 108.

Figure 10:
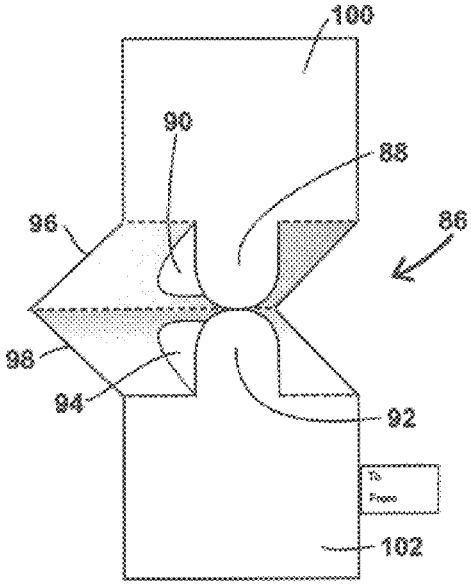

In FIG. 10, in a further embodiment, card 86 upper section 100 is connected to medial section 96 by a fold line and includes a tongue 88 leaving an opening 90 in medial section 96. Lower section 102 has a tongue 92 leaving an opening 94 in medial section 98. The two tongues 88 and 92 may approach or overlay each other. In some embodiments they may extend so far as to be inserted in the respective opening 94 or 90, fully or partially. The sections are all interconnected by fold lines.

Figure 11:
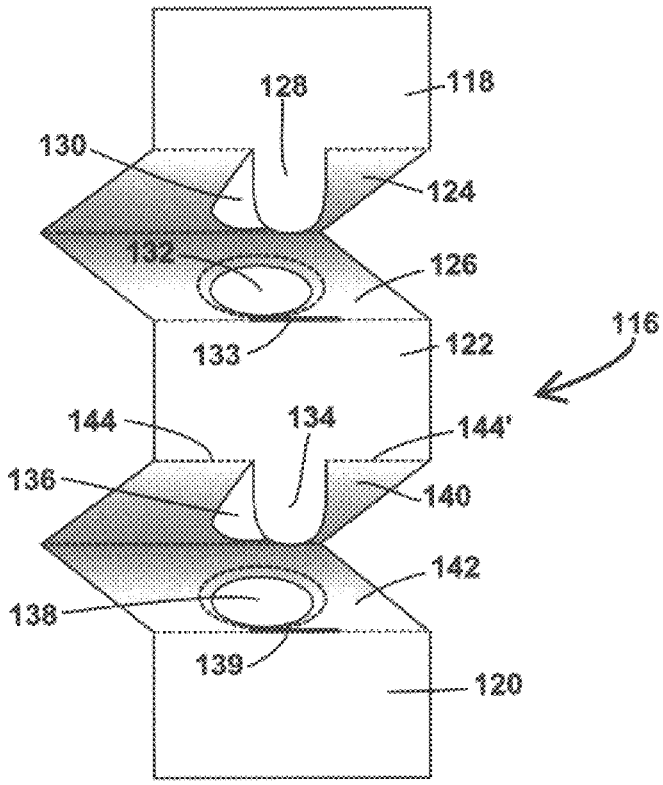

In FIG. 11, the illustrated, alternative card 116 comprises upper section 118 and lower section 120 with an intermediate section 122, all bearing cooperative decorative indicia and lying in parallel planes. Section 118 is connected to section 124 which in turn is connected to section 126 and thence to intermediate section 122, all connections being made by fold lines. Section 118 has a tongue 128 that mates with slit 133 at the junction of sections 126 and 122. Opening 132 in section 126 aligns with the opening 130 left in section 124 when folded as discussed above in the other embodiments.

A tongue 134 extends from section 122 leaving opening 136 in section 140, which connects to section 122 by fold line 144 and 144'. Section 142 is connected between sections 140 and 120 by respective fold lines. Opening 138 is provided in section 142. All openings align to receive a product when the medial sections 124, 126, 140 and 142 are folded as shown. Tongue 134 engages slit 139 in the folded state and tongue 128 engages slit 133. In this way the card 116 may be elongated and may receive multiple products or a single long product as desired.

The sections 118, 122 and 120 closely abut similar to sections 8 and 10 of the FIG. 1 embodiment, to form a single, decorative, common image. Of course, the different sections with indicia in all of the embodiments may have complementary decorative indicia forming separate images with a common theme, for example, or with different themes. Preferably, the tongues will be exposed and have indicia thereon in accordance with these themes, if desired.

Figure 12:
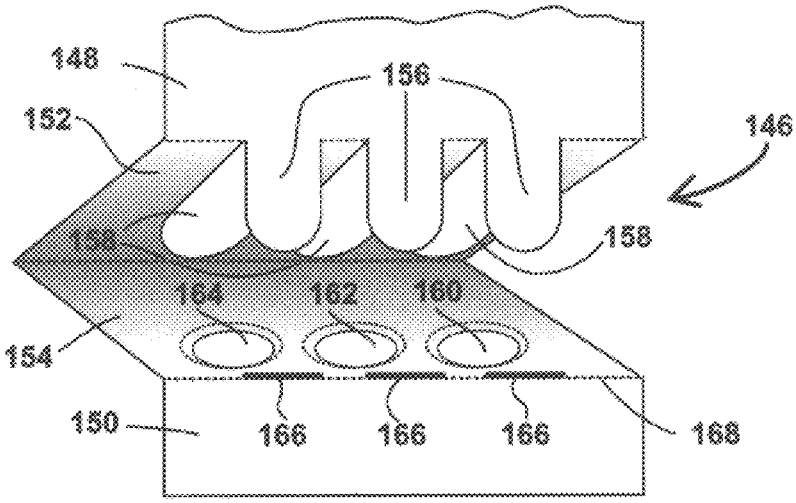

In FIG. 12, card 146 comprises upper section 148 and lower section 150, each with decorative indicia. Medial sections 152 and 154 are connected in series between sections 148 and 150 by fold lines. Tongues 156 extend from section 148 forming corresponding openings 158 in section 152. Openings 160, 162 and 164 in section 154 may be of the same or different dimensions and align with their respective corresponding openings 158. Slits 166 for receiving tongues 156 are at the junction of sections 150 and 154 at fold line 168. Three products of the same or different dimensions or shapes may be inserted through openings 160, 162 and 164. As noted above, the shapes of the openings may be of any suitable profile as desired for a given implementation. The tongues in this embodiment, as in all embodiments may have indicia thereon to cooperate with the indicia on the indicia receiving sections, such as sections 148 and 150, to form a decorative image or images. The tongues may be partially or fully inserted in the mating slits as needed for a given product.

Obviously, many modifications and variations of the present invention are possible in light of the above teachings. It is therefore to be understood that within the scope of the appended claims, the invention may be practiced otherwise than as specifically described.

What is claimed is:

1. A decorative gift or product card comprising:

a sheet material first section having a first display surface;

a sheet material second section having a second display surface;

a sheet material third section connected to the first section with a first fold line and having a first through opening and having a third display surface; and a sheet material fourth section connected between the second and third sections with respective second and third fold lines, the fourth section having a fourth display surface and a second through opening, the third and fourth sections being folded in juxtaposed relation with the first and second openings juxtaposed such that the third and fourth sections diverge from said third fold line to the respective first and second sections and the first and second sections are substantially coplanar or are in approximately parallel planes, wherein the first and second display surfaces form a front portion of said card, said third and fourth display surfaces recede from said front portion to said third fold, and wherein said third and fourth display surfaces are visible from said front portion of said card.

2. The card of claim 1 wherein the first section includes a tongue at said first opening, said tongue extending downwardly past said first fold line toward said second section, the first fold line being discontinuous adjacent to said tongue, the junction of the fourth section with the second section at said second fold line being adjacent to said tongue.

3. The card of claim 2 including a plurality of said tongues and a plurality of said first openings, each first opening corresponding to a different one of said plurality of tongues and a plurality of second openings, each first opening corresponding to a different second opening in juxtaposed relation.

4. The card of claim 2 including a plurality of second openings all corresponding to and aligned with the first opening in the juxtaposed relation.

5. The card of claim 2 including a plurality of said tongues and a plurality of said first and second openings, each of said tongues corresponding to a different corresponding one of said first openings and a different corresponding one of said second openings.

6. The card of claim 2 wherein the card is paperboard comprises a single piece of sheet material.

7. The card of claim 1 including an informational tab extending from one of the first and second sections.

8. The card of claim 7 wherein the tab is connected to one of the first and second sections by perforations for selective separation from the one of the first and second sections.

9. The card of claim 1 wherein at least one of the first and second openings is surrounded by a perforation for enlarging the one opening.

10. The card of claim 1 wherein at least the first and second sections have decorative indicia that manifest an integrated image.

11. The card of claim 10 wherein the third and fourth sections also have decorative indicia that, with the decorative indicia on the first and second sections, manifest an integrated image.

12. The card of claim 10 wherein the tongue includes decorative indicia cooperating with the indicia of the first and second sections to form an integrated image.

13. The card of claim 1 wherein the first section includes a first tongue and the second section includes a second tongue, the first tongue being formed from material from said first opening and the second tongue being formed from material from the second opening, the first and second fold lines being discontinuous adjacent to the respective tongues.

14. A decorative gift or product card comprising:

a sheet material first section having a first display surface;

a sheet material second section having a second display surface;

a sheet material third section connected to the first section by a first fold line and having a third display surface and a first through opening;

a sheet material fourth section connected between the second and third sections with respective second and third fold lines, the fourth section having a fourth display surface and a second through opening, the third and fourth sections being folded in juxtaposed relation with the first and second openings juxtaposed such that the third and fourth sections diverge from said third fold line to the respective first and second sections;

wherein, the first and second display surfaces form a front portion of said card, said third and fourth display surfaces recede from said front portion to said third fold, and wherein said third and fourth display surfaces are visible from said front portion of said card; and a tongue at the first opening, the first fold line being discontinuous across said tongue, the tongue being generally coplanar with the first section.

15. The card of claim 14 including an informational tab extending from one of the first and second sections.

16. A decorative card for use with a product comprising:

a sheet material formed into a plurality of first sections which include means for forming the first sections into a single decorative panel having a front display portion, each first section forming a different portion of the front display portion; and a product supporting sheet material member extending rearwardly away from said front display portion from at least one of the first sections and having an opening for receiving the product, said product supporting sheet material member having a display surface, and being so constructed and arranged to be visible from a front of said card.

17. The card of claim 16 wherein the sections are one piece and connected by fold lines.

18. The card of claim 16 wherein at least one of the first sections comprise a tongue extending therefrom, the product supporting sheet material comprising:

at least one pleat between an adjacent pair of said first sections.

19. The card of claim 18 wherein the opening of said product supporting sheet comprises a juxtaposed pair of openings for said receiving the product.

* * * * *